United States Patent [19]

Steiman

[11] 3,958,727

[45] May 25, 1976

[54] AEROSOL DISPENSER CONSTRUCTION

[75] Inventor: Wolf Steiman, Bridgeport, Conn.

[73] Assignee: VCA Corporation, Greenwich, Conn.

[22] Filed: Oct. 29, 1974

[21] Appl. No.: 518,790

[52] U.S. Cl. ..... 222/402.24
[51] Int. Cl.[2] ..... B65D 83/14
[58] Field of Search ..... 222/402.24, 402.25; 251/353

[56] References Cited

UNITED STATES PATENTS

| | | | |
|---|---|---|---|
| 2,565,954 | 8/1951 | Dey | 222/402.24 X |
| 2,818,202 | 12/1957 | Abplanalp | 222/402.24 |
| 3,033,425 | 5/1962 | Gawthrop | 222/402.24 X |
| 3,647,121 | 3/1972 | Ayres | 222/402.24 |

FOREIGN PATENTS OR APPLICATIONS

| | | | |
|---|---|---|---|
| 1,000,042 | 8/1965 | United Kingdom | 222/402.24 |

*Primary Examiner*—Allen N. Knowles
*Assistant Examiner*—Hadd Lane
*Attorney, Agent, or Firm*—H. Gibner Lehmann; K. Gibner Lehmann; E. Donald Mays

[57] ABSTRACT

A dispenser of the hand-held type for discharging fluid under pressure, comprising a container having an open top end, and a valve assemblage which is received in the open end and secured in place by means of a crimped ferrule. The container has a circular rim surrounding the opening, together with an annular external shoulder immediately adjacent the rim. The valve assemblage includes a valve housing defining a valve chamber, a resilient valve seat which constitutes one end of the chamber, and a movable valve stem having a longitudinal opening and transverse side passage adapted to communicate with the chamber when the stem is depressed. The housing further includes an annular mounting flange which engages and rests upon the rim of the container, and a depending skirt which bears against inner wall portions of the container, all to form a leakproof seal therewith. The ferrule extends over the annular mounting flange of the valve housing and is crimped onto the external shoulder of the container. The arrangement is such that only a single crimping operation is employed, instead of the two previously required in the fabrication of conventional can-type, valved dispensers.

1 Claim, 5 Drawing Figures

AEROSOL DISPENSER CONSTRUCTION

BACKGROUND

This invention relats generally to hand-held aerosol dispensers and more particularly to means for securing a valve assemblage to the open end of a dispensing container.

Prior pressurized dispensers have generally employed can-type containers having a domed top wall and a valve mounting cup, with peripheral edge portions of the latter crimped over the corresponding edge portion of the domed top. In virtually all cases, a rubber sealing gasket was employed, sandwiched between the crimped portions in order to provide a seal. In such constructions, the valve housing was usually mounted in an inverted, hollow portion of the valve mounting cup, the housing being crimped in place by suitable equipment, prior to the assembly of the valve mounting cup to the container.

Such a construction is illustrated in the copending application of Wolf Steiman and Steven W. Beres, U.S. Ser. No. 375,017 filed June 29, 1973 now U.S. Pat. No. 3,862,741, is issued Jan. 28, 1975 and having common ownership with the present application. Although the mounting arrangement for the valve housing as set forth in the above application was generally satisfactory, several disadvantages were apparent.

First two separate crimping operations were required. The first involved the securement of the valve housing in the inverted-hollow portion of the valve mounting cup. The second involved the crimping of the valve mounting cup itself onto the domed top wall or closure portion of the container. In addition, the use of a rubber sealing gasket between the cup ad domed wall involved an additional step in the assembly, and the gasket sometimes tended to cause contamination of the contents of the container. As a result, the assembly time and consequently the cost of producing such dispensers tended to be considerable. In addition, where prior dispensers have employed plastic containers, there has been a tendency for the plastic to shrink, causing an undesirable looseness of the parts, and thus increasing the likelihood of leakage and malfunction of the device.

SUMMARY

The above disadvantages and drawbacks of prior pressurized aerosol dispensers are obviated by the present invention, which has for an object the provision of a novel and improved dispenser which is simple in construction, economical to manufacture and yet which maintains an excellent degree of reliability. A related object is the provision of an aerosol dispenser wherein a rigid container such as a molded glass bottle can be employed with a valve assemblage having a resilient mounting portion which can be conveiently received in the container to form a leakproof seal therewith, all being retained in place by means of a simple crimped ferrule. A further object of the invention is the provision of a dispenser wherein the material of which the container is molded has non-varying dimensions, such that after assembly of the dispenser there is only minimal likelihood of the parts becoming loose due to rough handling, changes in temperature, etc. Still another object is the provision of a dispenser which can be assembled with but a single crimping operation as opposed to two distinct operations which have always been characteristic of prior devices of this type.

The above objects are accomplished by the provision of a pressurized dispenser comprising a container with an open top end and an annular rim surrounding the end, a valve assemblage adapted to be received in the open end, and a ferrule engaging the valve assemblage and being crimped over an external annular shoulder on the container adjacent the loation of the rim. The valve assemblage includes a valve housing having an anular flange which is supported by the rim of the container and a depending skirt which is received in the open end of the container and sealingly engages inner wall portions thereof. The valve assemblage comprises a resilient valve seat and a movable valve stem which is received in the chamber of the valve housing and normally biased to a closed, non-discharging position. The stem has a longitudinal bore and a transverse side passage enabling communication between the valve chamber and the bore of the stem when the latter is depressed. The arrangement is such that the internal pressure which occurs inside the container forces the walls of the depending skirt in a radially outward direction so as to achieve a tight engagement with the inner surfaces of the container neck, thus facilitating the sealing action between the two parts. A ferrule which is installed over the annular mounting flange is crimped around the external annular shoulder of the container. The arrangement is such that only a single crimping operation is required, as opposed to two which are normally involved in can-type pressurized dispensers.

Other features and advantages will hereinafter appear.

In the drawings, illustrating a preferred embodiment of the invention:

Figure 1:
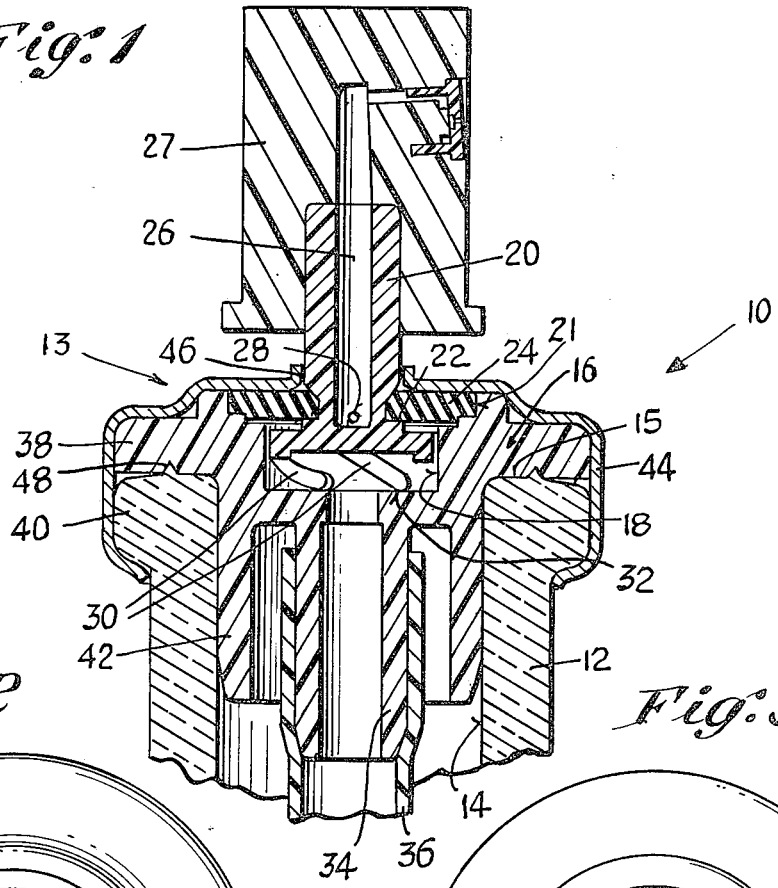
FIG. 1 is an axial sectional view of the improved aerosol valve construction of the present invention, showing a container, a valve assemblage disposed therein and a ferrule retaining the latter by means of a crimped portion around an annular shoulder of the container adjacent its rim.
Figure 2:
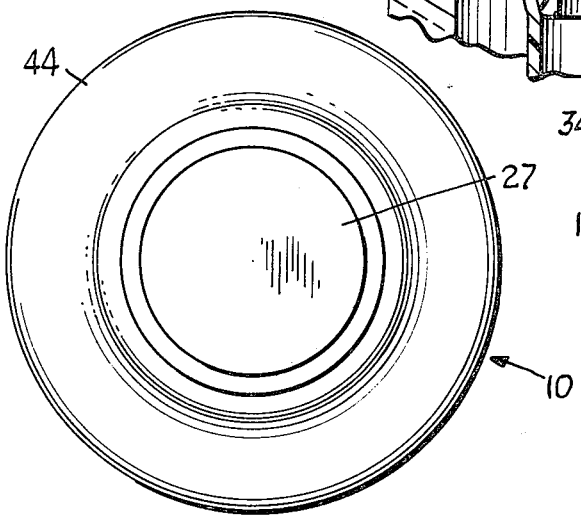
FIG. 2 is a top plan view of the dispenser of FIG. 1.

Referring to FIG. 1, there is illustrated a dispenser of the hand-held type for discharging fluid under pressure, the dispenser being generally designated by the numeral 10, and comprising a container 12 and a valve assemblage 13. As shown, the container 12 has an opening 14 (FIG. 5) and an annular rim 15 surrounding the opening. The valve assemblage 13 includes a valve housing 16 comprising a valve chamber 18, and a valve stem 20 which is axially movable with respect thereto. The housing has in its upper portion a substantially circular recess 21 which receives a resilient valve seat 24, as shown. The stem 20 includes a valve shoulder 22 which is normally engaged with the seat 24 when the valve is in the closed, non-discharging position illustrated in FIG. 1. In addition, the stem has a longitudinal bore 26, together with a side or transverse passage 28 communicating with the bore 26. An orificed depress or actuator button 27 is carried by the stem and is of conventional construction. A plurality of depending resilient spring fingers 30 extend downwardly from the stem and engage the lower wall portion 32 of the valve chamber 18 in such a manner as to normally bias the stem to the closed, non-discharging position. It will be understood that under these circumstances, the valve shoulder 22 sealingly engages the valve seat 24, the opening 28 being closed off by the latter. A depending nipple 34 extends from the valve chamber 18 and carries a dip tube 36 of usual construction, the latter extending to the bottom of the container. The operation of the valve is substantially identical to that of the construction described in copending application U.S. Ser. No. 375,017, now U.S. Pat. No. 3,862,741, issued Jan. 28, 1975, and need not be discussed further.

Figure 3:
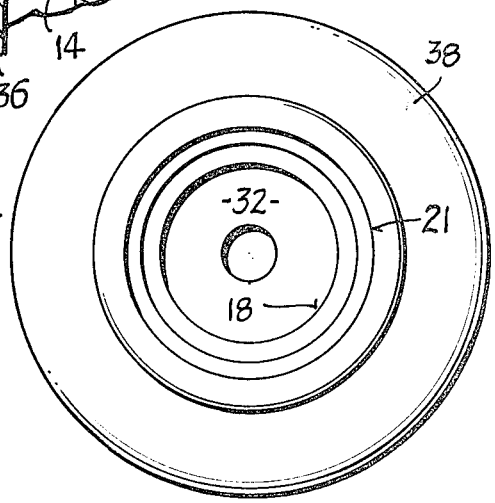
FIG. 3 is a top plan view of the valve housing portion of the dispenser of FIGS. 1 and 2.
Figure 4:
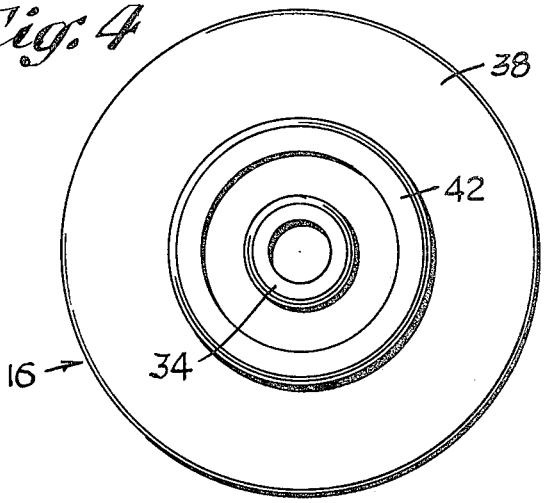
FIG. 4 is a bottom view of the valve housing of FIG. 3.

In accordance with the present invention, there is provided a novel arrangement for sealingly securing the valve assemblage 13 in the container 12. As shown in FIGS. 3 and 4, the valve assemblage has an annular mounting flange 38, which extends radially outward with respect to the axis of the valve housing and is adapted to be supported on the rim 15 of the container 12. The valve assemblage 13 further includes a depending skirt 42, which is received in the open end 14 of the container, the skirt 42 having such dimension as to provide a reasonably tight seal with the inner portion of the container wall. In addition, by the present invention the container 12 has an annular external shoulder 40 adjacent the location of the rim. The assemblage 13 is held in place by means of a mounting ferrule 44. During assembly, the ferrule is placed over the annular flange 38 of the assemblage and crimped over the external annular shoulder 40 of the container 12 by means of suitable crimping equipment (not shown). The ferrule has a substantially circular opening 46 which receives the upstanding portion of the valve stem 20, as particularly illustrated in FIG. 1. It will be seen that, in addition to abutting the flange 38, the ferrule 44 engages the upper surface of the valve seat 24, thus tending to retain the latter in a position wherein it occupies the recess 21 of the housing 16.

Figure 5:
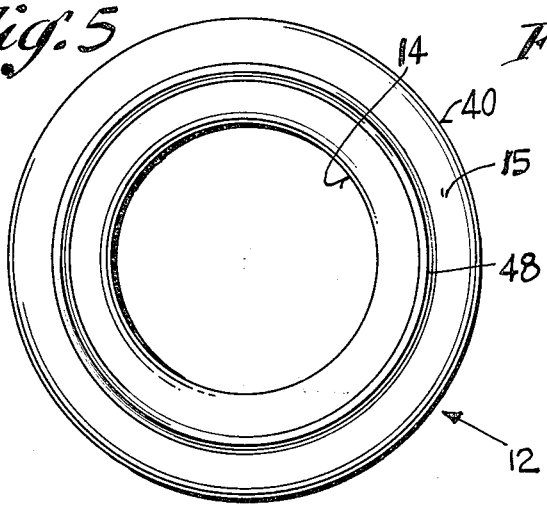
FIG. 5 is a top plan view of the container portion of the dispenser of FIGS. 1 and 2.

Referring to FIG. 5, by the present invention the rim 15 of the container further includes an upstanding annular sealing ridge 48 which becomes embedded in the lower surface of the annular flange 38 when the dispenser is assembled. This tends to provide an additional or secondary seal between the container 12 and the valve housing 16. In the case that the container is constituted of mold glass, the ridge 48 may be conveniently molded as an integral part thereof, thus reducing the overall cost.

The above construction has several distinct advantages. First, in contrast to prior devices for dispensing substances under pressure, the present construction provides increased ease of assembly, in that but a single crimping operation is required. Prior devices have often required two crimping operations, one for securing a valve housing in the inverted cup portion of the valve mounting cup, and the other for securing the mounting cup to the domed closure portion of the dispenser. In addition to providing simpler assembly, the present construction involves less cost and can conveniently make use of molded glass bottles, which can be manufactured and supplied today in large quantities with virtually no likelihood of shortags of raw material. In addition, the use of a glass container minimizes shrinkage and other deformations which might occur during or after the assembly of the dispenser. Consequently, the likihood of the seal between the valve housing 16 and the container 12 developing a leak is greatly minimized, since the container 12 can be manufactured as a rigid piece, and the resilience of the valve housing enables it to conform to the particular shape or dimension of the container. Also, the pressure occuring inside the container 12 tends to exert a force on the skirt 42 in a radially outward direction, causing a sealing engagement with the container walls. The above construction eliminates the need for a rubber sealing gasket, thus reducing the overall cost of the device and eliminating the possibility of contamination of the contents of the dispenser by the gasket.

From the above it can be seen that I have provided a novel and improved pressurized dispenser, which is extremely simple in construction and inexpensive to manufacture, as well as having excellent reliability. The device is thus seen to represent a distinct advance and improvement in the technology of pressurized dispensers.

Variations and modifications are possible without departing from the spirit of the invention.

I claim:

1. A valve construction for an aerosol dispenser comprising in combination:

a. a container having a neck portion with a cylindrical inner wall defining an upper opening which terminates in an annular rim having an external annular shoulder lying below the rim;

b. an integrally formed valve housing including a valve chamber having a central opening at its upper and lower ends, an integral nipple surrounding the lower opening and depending from the bottom of the valve chamber, an annular mounting flange extending outwardly from the upper portion of the chamber and sealingly seated on the rim, an annular skirt depending from the underside of the mounting flange coaxial with and spaced from the nipple and extending below the valve chamber and making sealing engagement with the cylindrical inner wall of the neck portion of the container;

c. a resilient annular valve seat having a central aperture and constituting the top wall portion of the valve chamber;

d. a valve stem having a hollow shank portion extending through the aperture of the valve seat, and futher having an annular valve shoulder disposed in the valve chamber and engageable with the valve seat to close off the aperture thereof;

e. said valve stem having a side opening disposed adjacent the shoulder and communicating with the hollow of the shank portion;

f. spring means biasing said shoulder into engagement with said seat; and g. a ferrule crimped over the external annular shoulder of the container so as to hold captive the valve seat and valve housing, said ferrule having a central opening for receiving the hollow shank portion of the valve stem.

* * * * *